United States Patent [19]

Shook

[11] 4,449,766

[45] May 22, 1984

[54] DRAWER GUIDE

[75] Inventor: James G. Shook, Goldsboro, N.C.

[73] Assignee: Kemp Furniture Industries, Inc., Goldsboro, N.C.

[21] Appl. No.: 407,142

[22] Filed: Aug. 11, 1982

Related U.S. Application Data

[63] Continuation of Ser. No. 383,237, May 28, 1982.

[51] Int. Cl.[3] ..... A47B 88/04

[52] U.S. Cl. ..... 312/348; 312/330 R; 312/332; 312/346; 312/347; 308/3.6

[58] Field of Search ..... 312/348, 332, 330 R, 312/341 NR, 333, 346, 347; 308/3.6

[56] References Cited

U.S. PATENT DOCUMENTS

| | | | |
|---|---|---|---|
| 2,992,057 | 7/1961 | Maxwell | 312/332 |
| 3,035,880 | 5/1962 | Hitchcock | 312/332 |
| 3,201,187 | 8/1965 | Reiss, Sr. et al. | 312/346 |
| 3,211,510 | 10/1965 | Reiss, Sr. et al. | 312/346 |
| 3,298,768 | 1/1967 | Vogt | 312/348 |
| 3,365,261 | 1/1968 | Gutner | 312/330 R |
| 3,702,717 | 11/1972 | Gutner | 312/347 |
| 3,751,126 | 8/1973 | Hudson | 312/348 |
| 3,926,492 | 12/1975 | Gutner | 312/348 |
| 3,929,386 | 12/1975 | Read | 308/3.6 |
| 4,061,375 | 12/1977 | Mertes | 312/348 |
| 4,183,596 | 1/1980 | Greene et al. | 312/348 |
| 4,305,625 | 12/1981 | Gutner et al. | 312/330 R |
| 4,389,079 | 6/1983 | Cosme | 312/330 R |

OTHER PUBLICATIONS

*Corax Corporation;* Drawer Guide Assembly, (No Date Shown), 1 Sheet of Drawing.

Photocopy of the Winzeler Chassis; Conventional Drawer Guide, Jan. 31, 1978, 1 Sheet of Dwng.

*Primary Examiner*—Victor N. Sakran

[57] ABSTRACT

The invention described herein comprises an improved drawer guide for furniture and includes a slide member which may be made of extruded metal, plastic or the like and has a narrow frontal portion. The narrowed portion allows easier drawer insertion than conventional drawer assemblies and also provides a stop means to prevent the drawer from being accidently pulled completely out of the furniture housing which may cause an inadvertent dumping of the contents of the drawer.

3 Claims, 6 Drawing Figures

DRAWER GUIDE

This is a continuation of application Ser. No. 383,237 filed May 28, 1982.

BACKGROUND AND OBJECTIVES OF THE INVENTION

In recent years the furniture industry has developed a number of devices to guide and stabilize sliding drawers in desks, cabinets, dressers and other places. Modern furniture often includes drawers manufactured with caliper type engaging means which, when the drawer is opened or closed, the engaging means slides along a guide member to prevent a wobble in the drawer's path. Since the customers often judge the quality of furniture by the straightness and evenness of a drawer's movement, furniture manufacturers have attempted to maintain a smooth rectilinear path of drawer travel by the use of various guide means and constructions. Even though a straight, level drawer movement can be obtained with conventional drawer guide assemblies, various problems have remained until this time and have plagued the industry without adequate solution.

The first of these problems which persist with the drawer mounted caliper engaging means and the housing method guide member is proper selection of the correct initial path for the drawer so that the engaging means correctly grasps the drawer guide when the drawer is inserted in the housing. Furniture salesmen and customers often become frustrated and angry while attempting to reinsert a drawer into a desk, dresser or other piece of furniture since the engaging means on the drawer is designed to a close tolerance for a firm grip with the drawer guide, resulting in many attempts and failures before the drawer is finally inserted.

Another problem which currently exists with drawer mounted caliper type engaging means which slide along the drawer guide is the problem of drawers being accidentally over extended and dumped. Since owners of furniture generally do not know the limits to which a drawer will extend, oftentimes in haste a drawer will be pulled totally free of its housing and its contents will often be spilled with disastrous results.

With this background in mind the present invention was conceived and one of its objectives is to provide a drawer guide for engagement with a caliper type drawer mounted engaging means which is relatively easy to manufacture and is inexpensive in cost.

It is another objective of the present invention to provide a drawer guide which includes a narrow frontal portion to assist in the initial insertion of a drawer into its housing.

It is yet another objective of the present invention to provide a drawer guide having a stop means thereon which will prevent the drawer from being accidently over extended causing the contents of the drawer to be discharged.

Other objectives and advantages of the present invention will become apparent to those skilled in the art as further explained below.

DESCRIPTION OF THE PREFERRED EMBODIMENT

The invention in its preferred form consists of a drawer guide formed of lightweight steel and has a slide member with a frontal narrow portion. For a guide of approximately 14 inches in length the narrowed portion may be approximatey one half to three quarters of an inch in length to allow for providing ease and convenience in inserting the drawer. Positioned approximately two inches from the narrowed frontal portion on the slide member are protuberances which act as stop means on opposing c-shaped rail means. The protuberances extend above the upper rail approximately one-eighth of an inch at their highest point and are approximately one half inches in length. The protuberances or stop means form a gentle mound-like configuration on the upper rails of the drawer guide so that, under sufficient pressure, the caliper like engaging means which is attached to the drawer will override the stop means in either the forward or the rearward direction as required.

DESCRIPTION OF THE DRAWINGS

Turning now to the drawings.

Figures 1, 2, 3, 4, 5, 6:
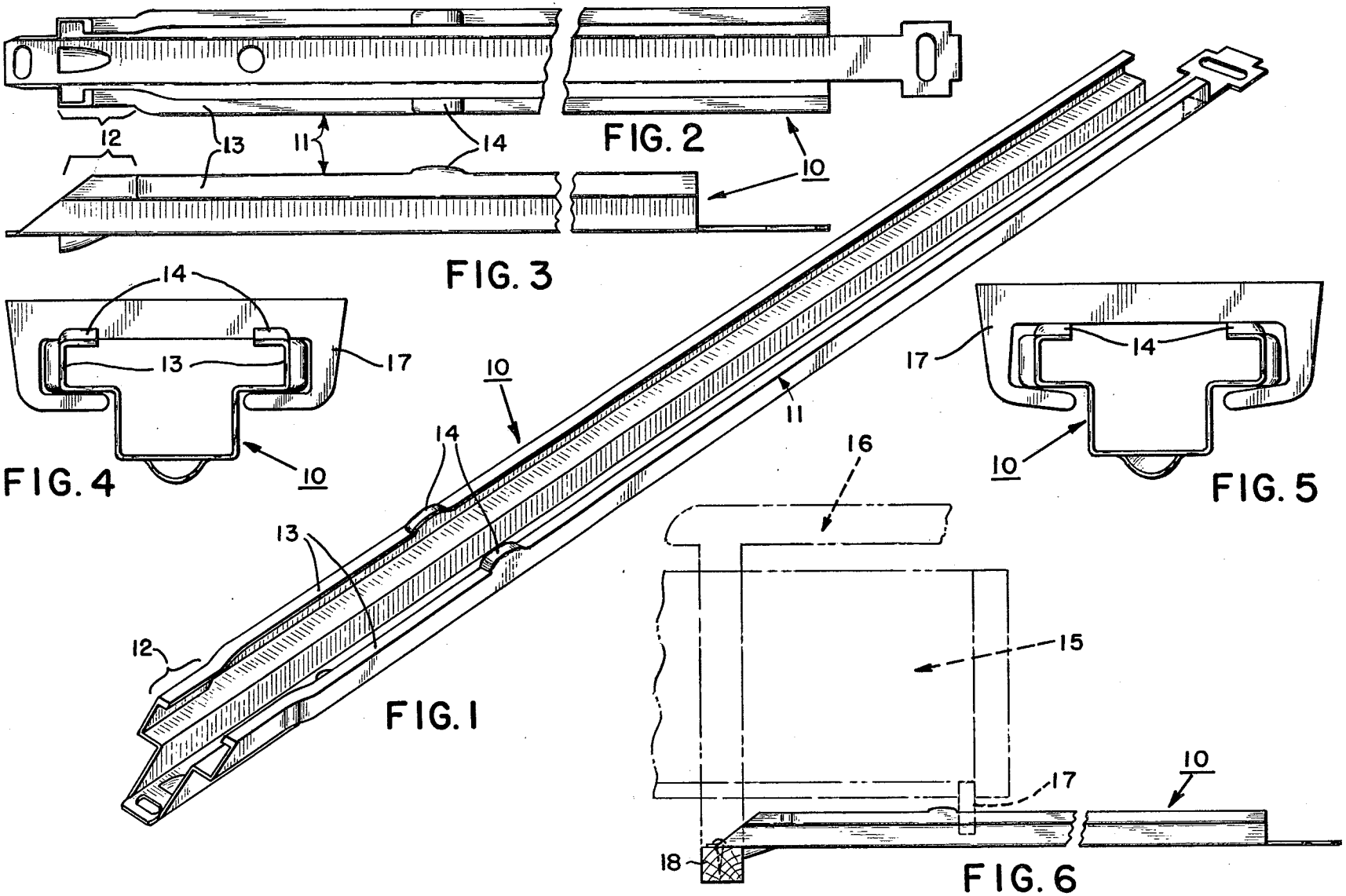
FIG. 1 demonstrates a perspective view of the preferred embodiment of the drawer guide of the present invention.
FIG. 2 demonstrates a top view of the drawer guide in fragmented fashion.
FIG. 3 illustrates a side elevational view of the drawer guide as shown in FIG. 2 also in fragmented form.
FIG. 4 illustrates a front elevational view of the drawer guide with a typical caliper engaging means.
FIG. 5 demonstrates the engaging means as shown in FIG. 4 as it passes over the top of the stop means.
FIG. 6 shows in schematic fashion the relationship of a typical drawer utilizing the present invention.

For a more detailed description of the invention, the drawer guide 10 as shown in FIG. 1 includes a slide member 11 having a narrow frontal portion or neck 12 and as earlier explained, neck 12 allows for easy insertion of the drawer after it has been completely removed from its housing. A suitable distance behind neck 12 and positioned on the upper portion of opposing spaced c-shaped rail means 13 are protuberances 14 which act as stop means for caliper engaging means 17 as shown in FIG. 6.

In FIG. 2 neck 12 is clearly shown as being narrower than the remaining portion of slide member 11 whereby opposing spaced c-shaped rail means 13 as shown in FIG. 4 have a close forward opposition and a less close opposition rearward of neck 12.

In FIG. 3 the elevation of stop means 14 is clearly depicted with its gentle sloping configuration. This gentle sloping allows stop means 14 to prevent drawer 15 as shown in FIG. 6 from being accidently pulled out of drawer housing 16 by halting caliper engaging means 17 as also shown in FIG. 6 but will allow, under sufficient pressure, caliper engaging means 17 to pass over stop means 14 as shown in FIG. 5 when desired as further shown in FIG. 6, drawer guide 10 is affixed to housing frame member 18 at its frontal portion. Thus, drawer 15 can be inserted and urged past stop means 14 since caliper engaging means 17 has sufficient flexibility as it is generally constructed of a suitable plastic or other material having the required resiliency. Also, if it is desirable to remove drawer 15 from its housing 16, then likewise, by applying sufficient pulling force, caliper engaging means 17 is suitably pliant to allow an intentional withdrawal but yet is rigid enough to prevent accidental release of drawer 15.

Various modifications and changes can be made to the present invention and the examples and illustrations shown herein are not intended for limiting purposes.

I claim:

1. A drawer guide for mounting in a housing for slideably engaging a drawer having a flexible engaging means comprising: a stationary slide member, said slide member having a relatively short frontal neck portion and an extended body portion, said neck portion for facilitating initial drawer insertion into the housing, said slide member having first and second c-shaped rail means, said first and second c-shaped rail means being opposingly spaced, said rail means having a close forward opposition and less close rearward opposition, a pair of mound-like stop means, one of said pair of stop means situated on said first c-shaped rail means and the other of said pair of stop means being positioned on said second c-shaped rail means, said pair of mound-like stop means for contacting the engaging means for retarding movement of the drawer whereby sufficient pressure will cause the engaging means to flex and override said stop means.

2. A drawer housing having an extendable drawer with a flexible engaging means mounted thereon comprising: a frame member, a slide member, said slide member mounted on said frame member, said slide member having a relatively short frontal neck portion and an extended body portion, said neck portion being narrower than said body portion, said neck portion for facilitating initial drawer insertion into the housing, stop means, said stop means having a mound-like configuration, said stop means being mounted on said slide member for contacting the engaging means for retarding the movement of the drawer whereby sufficient pressure will cause the engaging means to flex and override said stop means, said slide member having a first and second c-shaped rail means, said first and second c-shaped rail means being opposingly spaced, said rail means having a close forward opposition and a less close rearward opposition, a pair of stop means, one of said pair of stop means situated on said first c-shaped rail means and the other of said pair of stop means being positioned on said second c-shaped rail means.

3. A drawer housing having an extendable drawer with a flexible engaging means mounted thereon comprising: a frame member, a stationary slide member, said slide member mounted on said frame member, said slide member having first and second c-shaped rail means, said first and second c-shaped rail means being opposingly spaced, said rail means having a close forward opposition and a less close rearward opposition, said slide member having a relatively short frontal neck portion and extended body portion, said neck portion being narrower than said body portion, said neck portion for facilitating initial drawer insertion into the housing, stop means, said stop means having a mound-like configuration, said stop means being mounted on said slide member for contacting the engaging means for retarding the movement of the drawer whereby sufficient pressure will cause the engaging means to flex and override said stop means.

* * * * *